US011618599B2

(12) United States Patent
Spasov

(10) Patent No.: US 11,618,599 B2
(45) Date of Patent: Apr. 4, 2023

(54) STRAPPING MACHINE INCLUDING AN EDGE-PROTECTOR MAGAZINE HAVING A TELESCOPIC RAIL ASSEMBLY

(71) Applicant: Signode Industrial Group LLC, Glenview, IL (US)

(72) Inventor: Martin Spasov, Düsseldorf (DE)

(73) Assignee: Signode Industrial Group LLC, Tampa, FL (US)

( * ) Notice: Subject to any disclaimer, the term of this patent is extended or adjusted under 35 U.S.C. 154(b) by 233 days.

(21) Appl. No.: 16/917,984

(22) Filed: Jul. 1, 2020

(65) Prior Publication Data

US 2021/0002009 A1 Jan. 7, 2021

(30) Foreign Application Priority Data

Jul. 3, 2019 (DE) ..... 102019117949.1

(51) Int. Cl.
*B65B 13/18* (2006.01)
*B65B 13/02* (2006.01)

(52) U.S. Cl.
CPC ..... *B65B 13/181* (2013.01); *B65B 13/02* (2013.01)

(58) Field of Classification Search
CPC ..... B65B 13/02; B65B 13/04; B65B 13/181; B65B 13/20
USPC ..... 100/2, 8; 53/580, 582, 589, 139.6, 139.7
See application file for complete search history.

(56) References Cited

U.S. PATENT DOCUMENTS 3,271,925 A 9/1966 Aubrey
3,378,987 A * 4/1968 Lems ..... B65B 13/181 53/529
4,048,839 A 9/1977 Peterpaul
4,480,460 A 11/1984 Bush et al.
4,587,791 A 5/1986 Brouse et al.
4,700,530 A * 10/1987 Norberg ..... B65B 13/181 53/399
5,289,668 A 3/1994 Meyer
5,307,664 A 5/1994 Homm
5,311,996 A 5/1994 Duffy et al.
5,423,118 A 6/1995 Lotti
5,551,212 A 9/1996 Odenthal
5,564,254 A * 10/1996 Thimon ..... B65B 13/181 53/410
5,596,863 A 1/1997 Kasel
5,619,838 A 4/1997 Kasel
5,878,548 A 3/1999 Sauer et al.
6,540,080 B2 4/2003 Moreyra
(Continued)

FOREIGN PATENT DOCUMENTS

DE 202013002503 U1 6/2014
EP 1491447 A1 12/2004
(Continued)

OTHER PUBLICATIONS

"Canadian Office Action", from corresponding Canadian Patent Application No. 3085124 (5 pages), dated Aug. 17, 2021.
(Continued)

*Primary Examiner* — Jimmy T Nguyen
(74) *Attorney, Agent, or Firm* — Neal, Gerber & Eisenberg LLP

(57) ABSTRACT

Various embodiments of the present disclosure provide a strapping machine including an edge-protector magazine having a telescopic rail assembly.

13 Claims, 16 Drawing Sheets

(56) References Cited

U.S. PATENT DOCUMENTS

| | | | | |
|---|---|---|---|---|
| 7,213,381 | B2 | 5/2007 | Zitella et al. | |
| 7,383,952 | B2 | 6/2008 | Kruelle et al. | |
| 7,428,865 | B1 | 9/2008 | Kasel et al. | |
| 10,017,283 | B2 | 7/2018 | Kastner | |
| 10,099,808 | B2 | 10/2018 | Termanas et al. | |
| 2002/0014052 | A1 | 2/2002 | Suolahti | |
| 2005/0108989 | A1 | 5/2005 | Dickner | |
| 2011/0219845 | A1 | 9/2011 | Schurder et al. | |
| 2012/0055123 | A1* | 3/2012 | Brunson | B65B 9/135 53/558 |
| 2014/0311092 | A1 | 10/2014 | Flores et al. | |
| 2016/0114918 | A1 | 4/2016 | Kastner | |
| 2016/0152363 | A1 | 6/2016 | Termanas et al. | |
| 2018/0244413 | A1 | 8/2018 | Oehm et al. | |

FOREIGN PATENT DOCUMENTS

| | | | |
|---|---|---|---|
| EP | 2700577 | B1 | 10/2014 |
| EP | 2660158 | B1 | 1/2015 |
| EP | 2700578 | B1 | 1/2015 |
| EP | 2700579 | B1 | 3/2015 |
| EP | 2778075 | B1 | 6/2015 |
| EP | 2778076 | B1 | 6/2015 |
| EP | 2733077 | B1 | 9/2015 |
| EP | 2878541 | B1 | 4/2016 |
| JP | 2004331077 | A | 11/2004 |
| WO | 2020197847 | A1 | 1/2020 |

OTHER PUBLICATIONS

"Canadian Office Action", from corresponding Canadian Patent Application No. 3,085,124, dated Mar. 9, 2022.

"German Office Action", from corresponding German Patent Application No. 10 2019 117 949.1, with English translation, dated Feb. 18, 2020.

Original and Machine Translation for Extended European Search Report dated Nov. 16, 2020.

"Examination Report", translation, from corresponding European Patent Application No. 20183428.0, dated Nov. 30, 2021.

"Communication pursuant to Article 94(3) EPC", with English translation, from corresponding European Patent Application No. 20183428.0, dated Aug. 24, 2022.

* cited by examiner

STRAPPING MACHINE INCLUDING AN EDGE-PROTECTOR MAGAZINE HAVING A TELESCOPIC RAIL ASSEMBLY

PRIORITY CLAIM

This patent application claims priority to and the benefit of German Patent Application No. 10 2019 117 949.1, which was filed on Jul. 3, 2019, the entire contents of which are incorporated herein by reference.

FIELD

The present disclosure relates to strapping machines, and more particularly to strapping machines configured to position edge protectors on the edges of a load so the edge protectors are positioned between the strap and the load after the strap is applied around the load to protect the edges of the load from being damaged by the strap.

BACKGROUND

Strapping machines apply plastic or metal strap around a load to facilitate transporting the load. Loads may be formed from multiple individual goods assembled on load carriers—such as pallets—so as to form the larger load. The strap secures the individual goods together (and, if applicable, to the load carrier) to ensure the goods do not separate from one another (and, if applicable, from the load carrier) during transport. The individual goods may be any suitable types of goods, such as lumber, corrugated sheets, corrugated boxes in a flattened state, or boxes filled with goods.

One known strapping machine includes a packing table having multiple rotatably mounted rollers. At least two vertical supports straddle the packing table and support press plate that includes a press surface aligned parallel to the packing table and that is vertically movable toward and away from the packing table (and the load thereon). A strap chute into which the strap is inserted and guided around the load is formed by the press plate, the vertical supports, and the packing table. To strap a load positioned beneath the press plate, the press place descends to contact and stabilize and/or compress the load, depending on the goods that make up the load. The strap is then inserted into the strap chute, which guides the strap around the load. The strap is then withdrawn from the strap chute into contact with the load and tensioned about the load.

One known strapping machine positions edge protectors along the edges of the load before applying the strap to the load to protect the load from being damaged by the strap. To this end, at least one magazine in which edge protectors are stored is located on the press plate. A conveying unit discharges an edge protector from the magazine to a positioning unit disposed on the press plate. The positioning unit then moves the edge protector to the edge of the load.

SUMMARY

Various embodiments of the present disclosure provide a strapping machine for positioning an edge protector on an edge of a load and for strapping the load. The strapping machine comprises a packing table, two supports on opposing sides of the packing table, a press plate supported by and vertically movable relative to the supports, and an edge-protector magazine supported by the press plate. The packing table, the supports, and the press plate define a strap chute. The edge-protector magazine comprises a magazine frame defining a storage space sized to receive a stack of edge protectors; a telescopic rail assembly supported by the magazine frame; a conveying unit mounted to the telescopic rail assembly and movable between a home position and a discharge position, wherein at least part of the conveying unit is below the storage space when in the home position and removed from the storage space when in the discharge position; and a drive operably connected to the telescopic rail assembly and configured to extend the telescopic rail assembly to move the conveying unit in a discharging direction from its home position to its discharge position and to retract the telescopic rail assembly to move the conveying unit in a retracting direction from its discharge position to its home position.

Various embodiments of the present disclosure provide a method of operating a strapping machine. The method comprises extending a telescopic rail assembly of an edge-protector magazine to move a conveying unit carrying an edge protector from a home position to a discharge position, wherein the edge-protector magazine comprises a magazine frame defining a storage space sized to receive a stack of edge protectors, wherein at least part of the conveying unit is below the storage space when in the home position and removed from the storage space when in the discharge position; and after the edge protector is removed from the conveying unit, retracting the telescopic rail assembly to move the conveying unit from the discharge position to the home position.

DETAILED DESCRIPTION

Figure 1:
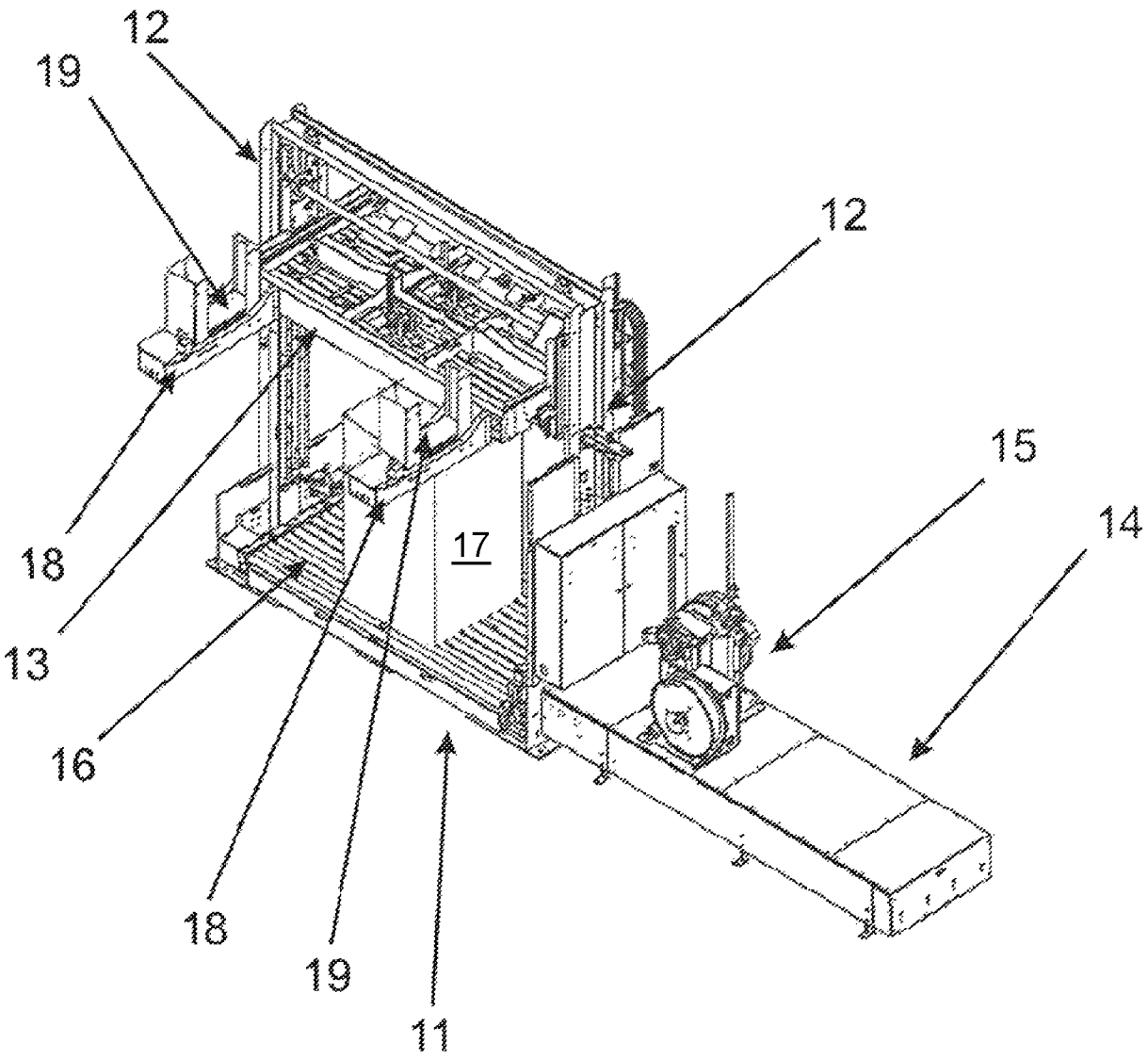
FIG. 1 illustrates one example embodiment of the strapping machine of the present disclosure.

FIG. 1 shows one example embodiment of the strapping machine 10 of the present disclosure. The strapping machine 10 comprises a packing table 11, two vertical supports 12 on opposing sides of the packing table 11, and a press plate 13 supported by and vertically movable relative to the vertical supports 12. A bayonet housing 14 that houses a bayonet (not shown) is laterally offset from the packing table 11. The bayonet is extendable from a retracted position within the bayonet housing 14 to an extended position in which the bayonet is above the packing table 11 and extends through skids of a pallet, as is known in the art. A strap supply 15 from which strap is drawn is disposed on the bayonet housing 14.

The packing table 11 includes multiple rotatably mounted rollers 16 on which a load 17 can be guided through the strapping machine 10.

A strap chute (not labeled) extends along the vertical supports 12 and the press plate 13, as well as in the packing table 11. When extended, the bayonet forms the bottom of the strap chute instead of the packing table 11. For the load 17 to be strapped, the strap is drawn from the strap supply 15 and is introduced into the strap chute, which guides the strap around the load 17. The strap is retracted from the strap chute and onto the load, and then tensioned.

As can be seen from FIG. 1, the press plate 13 supports two edge-protector magazines 18 each storing multiple edge protectors 19. Each edge-protector magazine 18 discharges the edge protectors 19 and supplies them to a positioning unit (not shown) disposed below the press plate 13. The positioning unit moves the edge protector 19 to the edge of the load so as to position dispose the edge protector 19 between the load 17 and the strap and to thus protect the load 17 from being damaged by the strap.

The edge-protector magazine 18 with the magazine frame 24 thereof is shown in various external views in FIGS. 2 to 5 and will now be described in detail hereunder.

Figure 2:
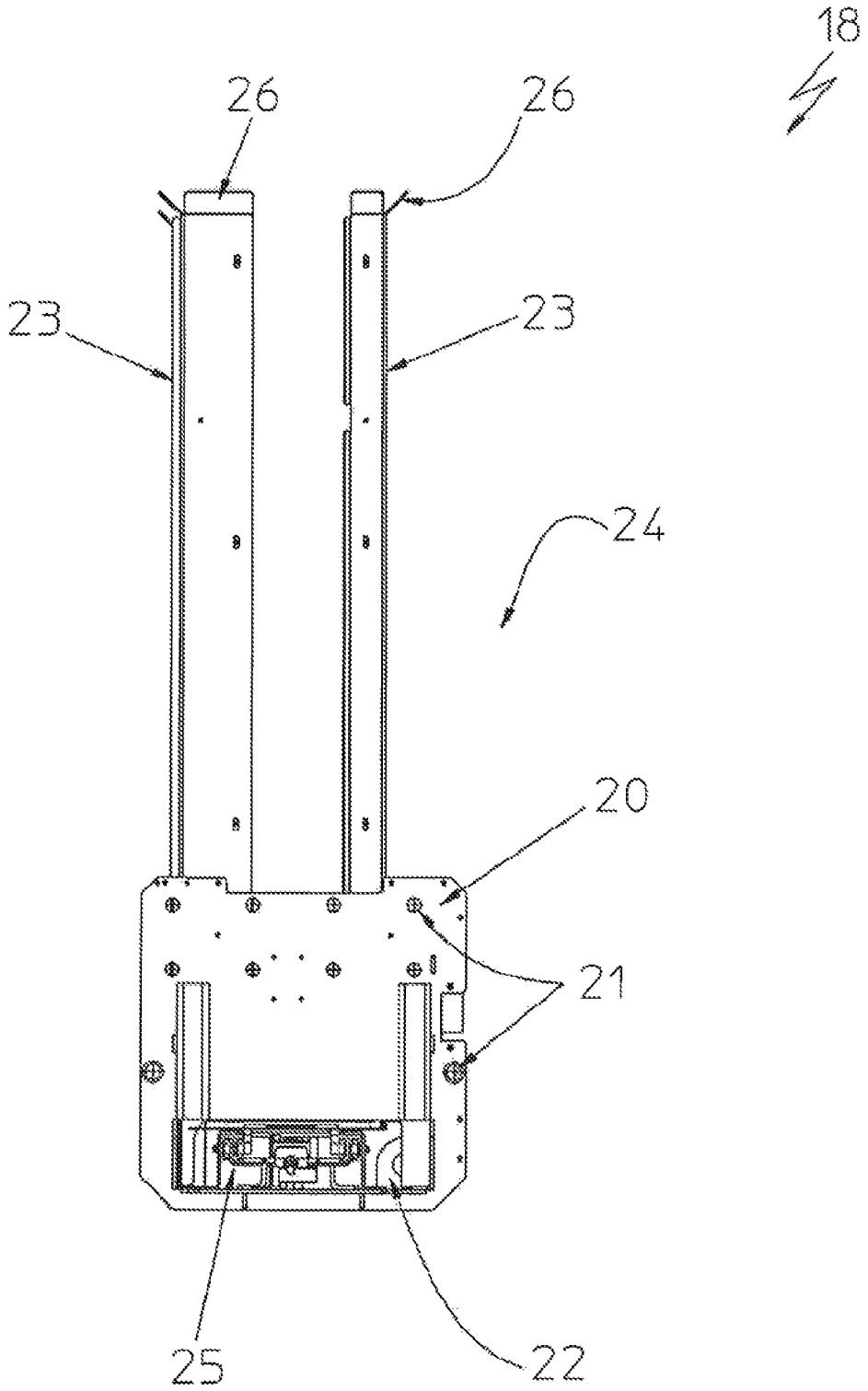
FIG. 2 illustrates an edge-protector magazine of the strapping machine of FIG. 1 in a view onto the assembly plate.

FIG. 2 shows the edge-protector magazine 18 in a view onto the front side pointing toward the press plate 13. The edge-protector magazine 18 includes an assembly plate 20 provided with multiple bores 21 used with fasteners (not shown) to secure the edge-protector magazine 18 on the press plate.

The assembly plate 20 defines a passage opening 22 sized and shaped in such a manner that a discharging unit can pass therethrough so as to move an edge protector 19 to the positioning unit below the press plate 13.

The edge-protector magazine 18 includes four receptacle supports 23 that are rectangular in cross section. The receptacle supports 23 close to the press plate are illustrated in FIG. 2. As will yet be described in more detail hereunder, the receptacle supports 23 define a receptacle space 27 for edge protectors 19. The passage opening 22 allows a view into the magazine frame 24 within which a telescopic rail assembly 25 is located, the telescopic rail assembly 25 yet to be described in detail below.

The receptacle supports 23 at the upper exposed ends thereof are provided with outwardly projecting guide lips 26. The guide lips 26 are configured to facilitate the insertion of edge protectors 19, in particular of edge protectors 19 that are placed on top of one another in the manner of a stack.

Figure 3:
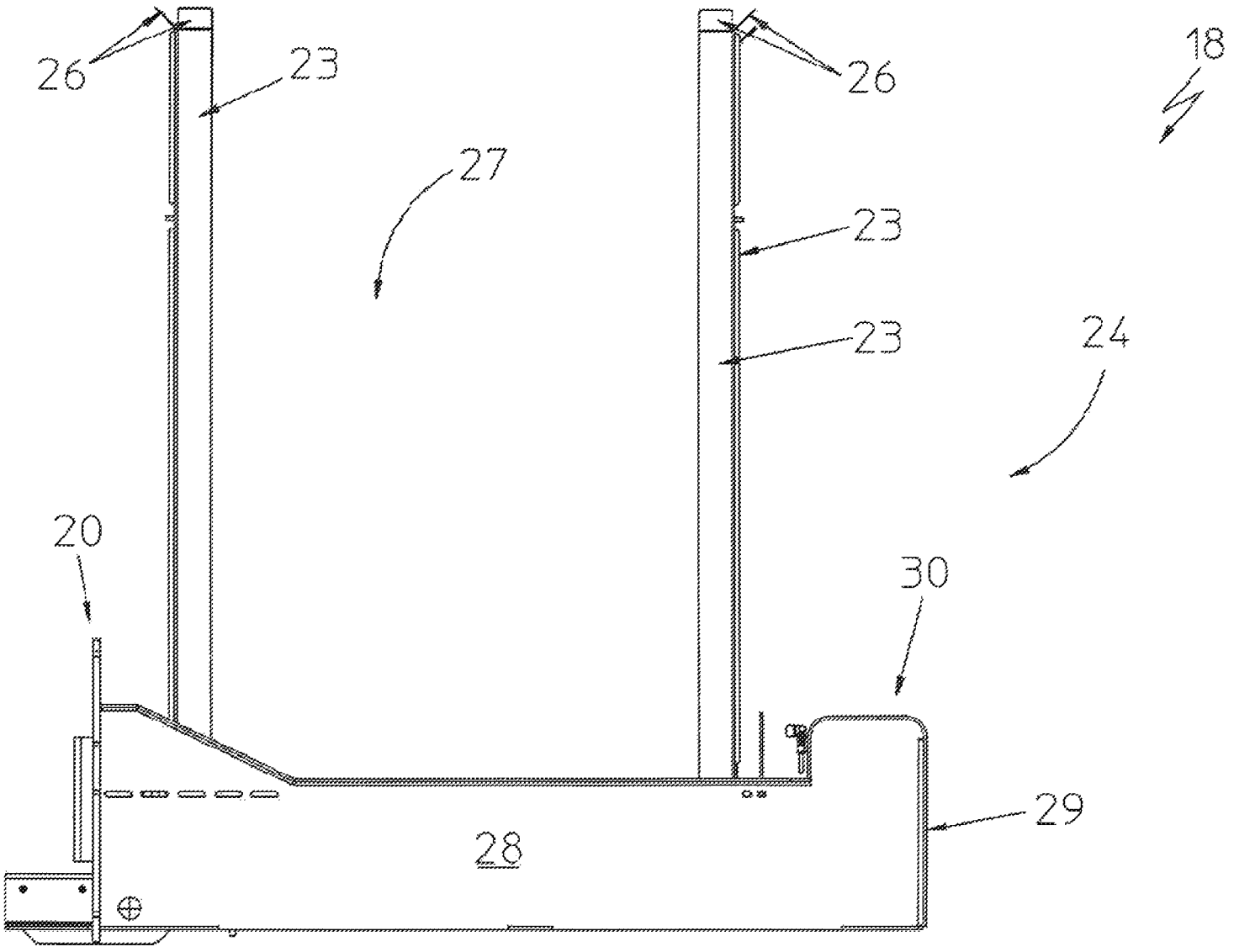
FIG. 3 illustrates the edge-protector magazine of FIG. 2 in a lateral view.

FIG. 3 shows the edge-protector magazine 18 with the magazine frame 24 thereof in a lateral view. Besides the front receptacle supports 23, the rear receptacle supports 23, thus the receptacle supports 23 which face away from the press plate, are also shown here. As has already been described in the context of FIG. 2, the receptacle supports 23 that face away from the press plates also possess guide lips 26 that are configured to facilitate the insertion of edge protectors 19, in particular edge protectors 19 that are placed on top of one another in the manner of a stack. A storage space 27 for edge protectors 19 is formed between the receptacle supports 23.

The assembly plate 20 close to the press plate can also be seen, as well as frame walls 28 that extend rearward from the assembly plate 20 so as to be remote from the press plate. A rear wall 29 extends between the ends of the frame walls 28 that are remote from the press plate. The frame walls 28 in the end region thereof remote from the press plate configure a drive space 30 which lies behind the rear receptacle supports 23, in which drive space 30 a drive (not illustrated in more detail and yet to be described in more detail) operable to discharge edge protectors 19 can be disposed.

Figure 4:
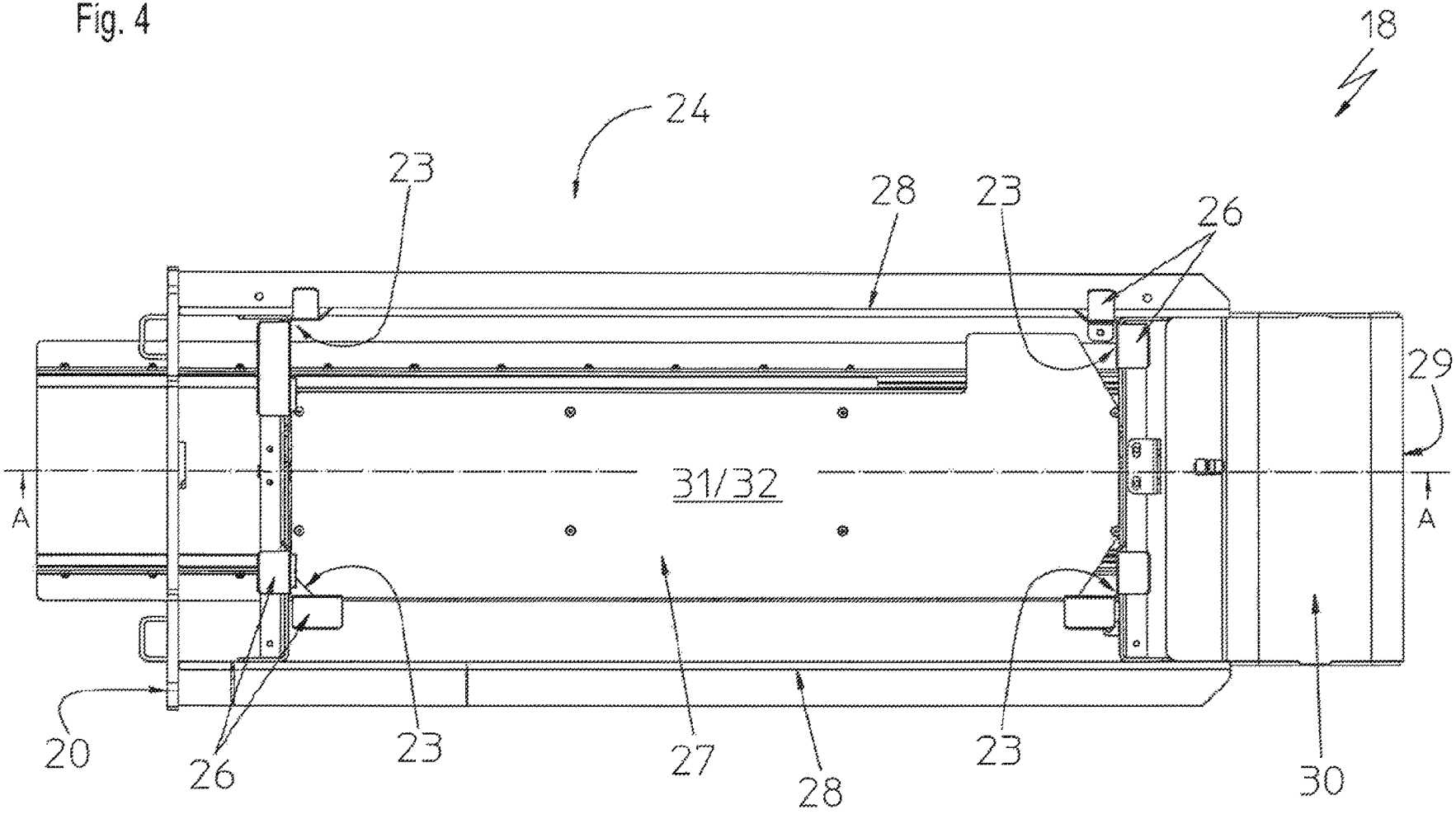
FIG. 4 illustrates the edge-protector magazine of FIG. 2 in a view from above.

FIG. 4 shows a view from above onto the edge-protector magazine 18. Apart from the components already described in detail in the context of FIGS. 2 and 3, the conveying member 31 in the form of receptacle plate 32 for edge protectors 19 is also shown herein in its home position. The receptacle plate 32 is located in the region of the storage space 27 for the edge protectors.

Figure 5:
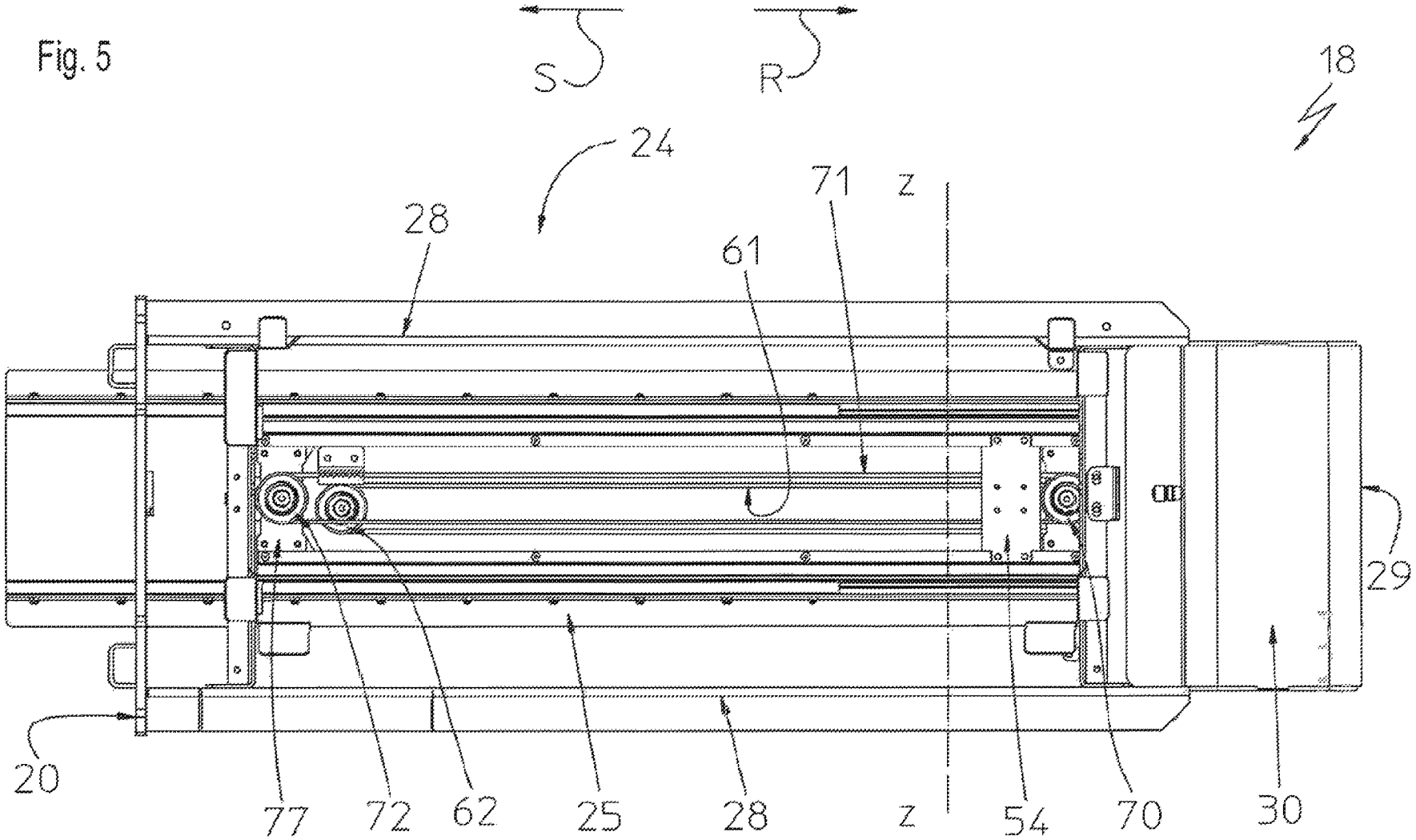
FIG. 5 illustrates the edge-protector magazine of FIG. 2 in a view from above with the discharge plate removed.

The illustration in FIG. 5 corresponds substantially to the illustration according to FIG. 4. However, the conveying member 31 has been removed in FIG. 5 such that a view onto the telescopic rail assembly 25 already mentioned in FIG. 2 is now possible. The construction of the telescopic rail assembly 25 will now first be explained with respect to of FIG. 13, the latter being a sectional illustration according to the section line B-B in FIG. 10. The position of the section line B-B in FIG. 10 herein corresponds to the position of the line Z-Z in FIG. 5. For clarity, the sectional illustration in FIG. 13 does not show various parts of the magazine frame 24 of the edge-protector magazine 18.

Figure 13:
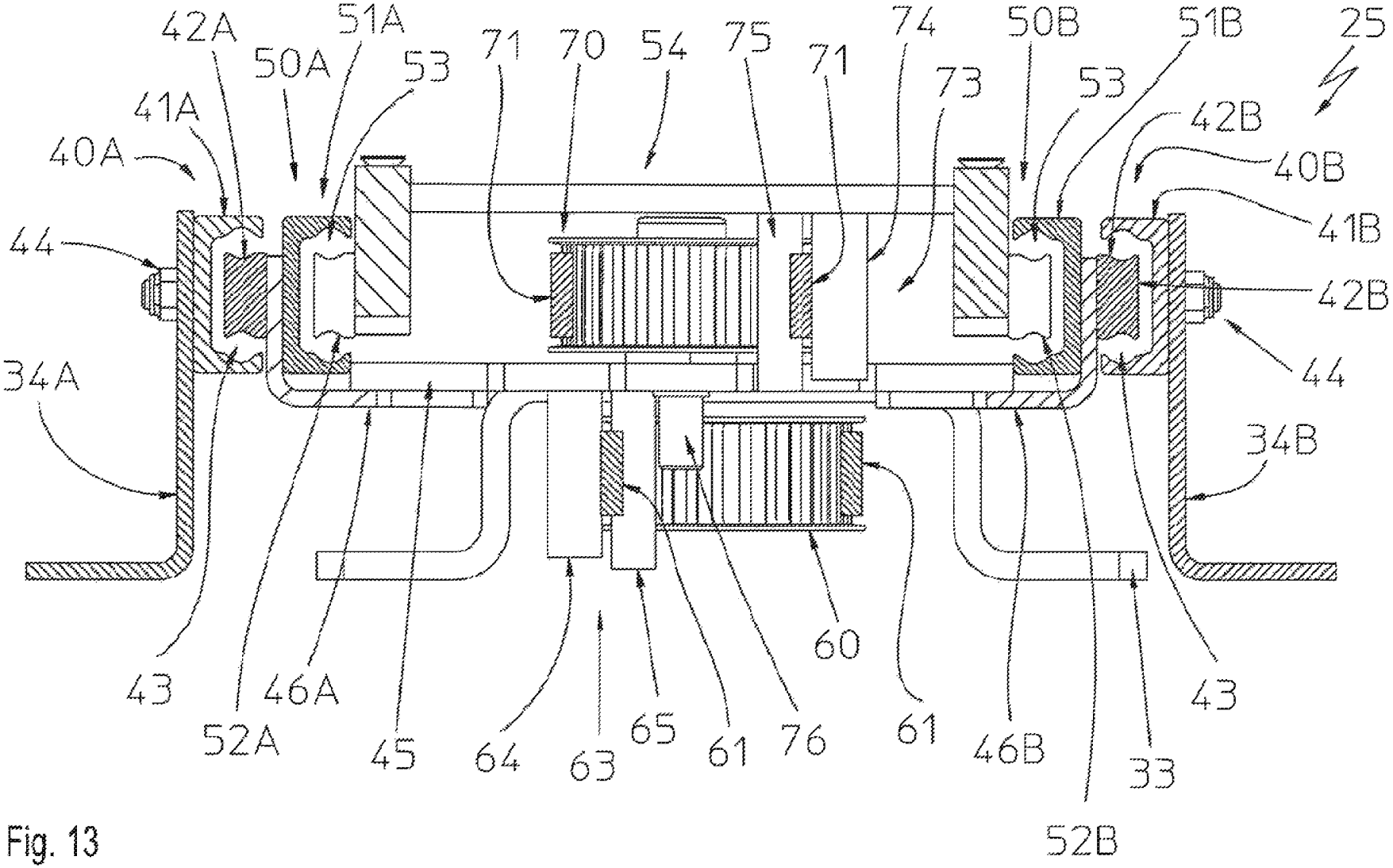
FIG. 13 illustrates the telescopic rail assembly in a cross-sectional view according to the section line B-B in FIG. 10.

FIG. 13 first shows an outer pair of telescopic rails 40 including the first telescopic rails 40A and 40B. Each first telescopic rail is composed of an outer guide rail 41A/41B in which an inner guide rail 42A/42B is in each case disposed so as to be movable in a longitudinal manner. Friction-reducing components, such as ball bearings, are not shown in the drawings for clarity but are disposed in an intermediate space 43 between the outer guide rails 41A/41B and the in the guide rails 42A/42B. The friction-reducing components are configured to minimize friction in an extension movement of the respective inner guide rails 42A/42B from the outer guide rail 41A/41B.

The outer pair of telescopic rails 40 by way of the outer guide rails 41A/41B thereof is in each case fastened to a bracket 34A/34B and mounted so as to be locationally fixed in relation to the magazine frame 24. To this end, screw connections 44 are used in this example embodiment. The inner guide rails 42A/42B are connected to one another by way of an assembly plate 45 fastened to assembly angle brackets 46A/46B. By virtue of this connection, the telescopic rails 40A and 40B, more specifically the inner guide rails 42A/42B thereof, in a deployment or retracting movement in principle move simultaneously and in the same direction.

The telescopic rail assembly 25 furthermore comprises an inner pair of telescopic rails 50. The inner pair of telescopic rails 50 comprises second telescopic rails 50A and 50B that in turn comprise in each case an outer guide rail 51A and 51B, respectively, and an inner guide rail 52A and 52B. Here too, the inner guide rails 52A/52B are guided in the outer guide rails 51A/51B. In an intermediate space 53, visible in FIG. 13, there are again located friction-reducing components such as ball bearings so as to minimize the friction when extending the inner guide rails 52A/52B from the outer guide rails 51A/51B. These friction-reducing components are not illustrated for clarity.

The outer guide rails 51A and 51B are fastened to the assembly angle brackets 46A and 46B of the outer telescopic rails 40A and 40B. The outer guide rails 51A and 51B thus move simultaneously with and in the same direction as the inner guide rails 42A and 42B of the outer telescopic rails 40A and 40B. Since the inner guide rails 52A and 52B of the second pair of telescopic rails 50 are mounted in the corresponding outer guide rails 41A and 41B, the inner guide rails 52A and 52B also conjointly perform the respective movement of the inner guide rails 42A and 42B of the outer pair of telescopic rails 40.

The inner guide rails 52A and 52B are connected to one another by way of an assembly bridging bracket 54 such that a deployment or retracting movement of the inner guide rails 52A and 52B takes place simultaneously and in the same direction.

FIG. 13 furthermore shows a drive mount 33 that is not part of the telescopic rail assembly 25 in the strict sense. This drive mount 33 is also disposed so as to be locationally fixed on the magazine frame 24. The drive mount 33 serves for fastening a drive, in particular a motor such as a servomotor. Moreover, the drive mount 33 supports a first belt pulley 60. The first belt pulley 60 is operatively connected to the motor and is rotatably driven by the latter. A first drive belt 61 is placed about the first belt pulley 60 and is guided to a second belt pulley 62 not visible here. A first belt clamp 63, formed by a first clamping jaw 64 and the second clamping jaw 65, encompasses the first drive belt 61 and is captively fastened to the latter. Consequently, the first belt clamp 63 follows each movement of the first drive belt 61.

The first belt clamp 63 is connected to the assembly plate 45 and, by way of the assembly angle brackets 46A and 46B, thus also to the first telescopic rails 40A and 40B of the outer pair of telescopic rails 40. More specifically, the coupling is to the inner guide rails 42A and 42B of the first pair of telescopic rails 40.

A connection to the outer guide rails 51A and 51B of the second pair of telescopic rails 50 also exists by way of the assembly plate 45 and the assembly angle brackets 46A and 46B.

When the previously mentioned motor rotatably drives the first belt pulley 60, the first drive belt 61 is set in motion. The movement of the first drive belt 61, by virtue of the coupling by way of the assembly plate 45 and the assembly angle brackets 46A and 46B, is consequently performed by the inner guide rails 42A and 42B of the outer pair of telescopic rails 40 as well as by the outer guide rails 51A and 51B of the inner pair of telescopic rails 50. The guide rails 42A and 42B, and 51A and 51B, can thus be deployed or retracted in this way.

The assembly plate 45 supports a third belt pulley 70 rotatably mounted on a pulley axle 76. A second drive belt 71 guided to a fourth belt pulley 72 (not illustrated here) is placed about the third belt pulley.

A second belt clamp 73, consisting of a third clamping jaw 74 and a fourth clamping jaw 75, is established on the second drive belt 71 and therefore conjointly performs the movement of the second drive belt 71.

The second belt clamp 73 is fastened to the assembly bridging bracket 54. The assembly bridging bracket 54 is fastened to the inner guide rails 52A and 52B of the inner pair of telescopic rails 50. Consequently, the inner guide rails 52A and 52B perform each movement of the second drive belt 71 and can thus be deployed or retracted, respectively. The assembly bridging bracket 54 moreover serves for fastening the conveying member 31 configured as the receptacle plate 32.

Figure 6:
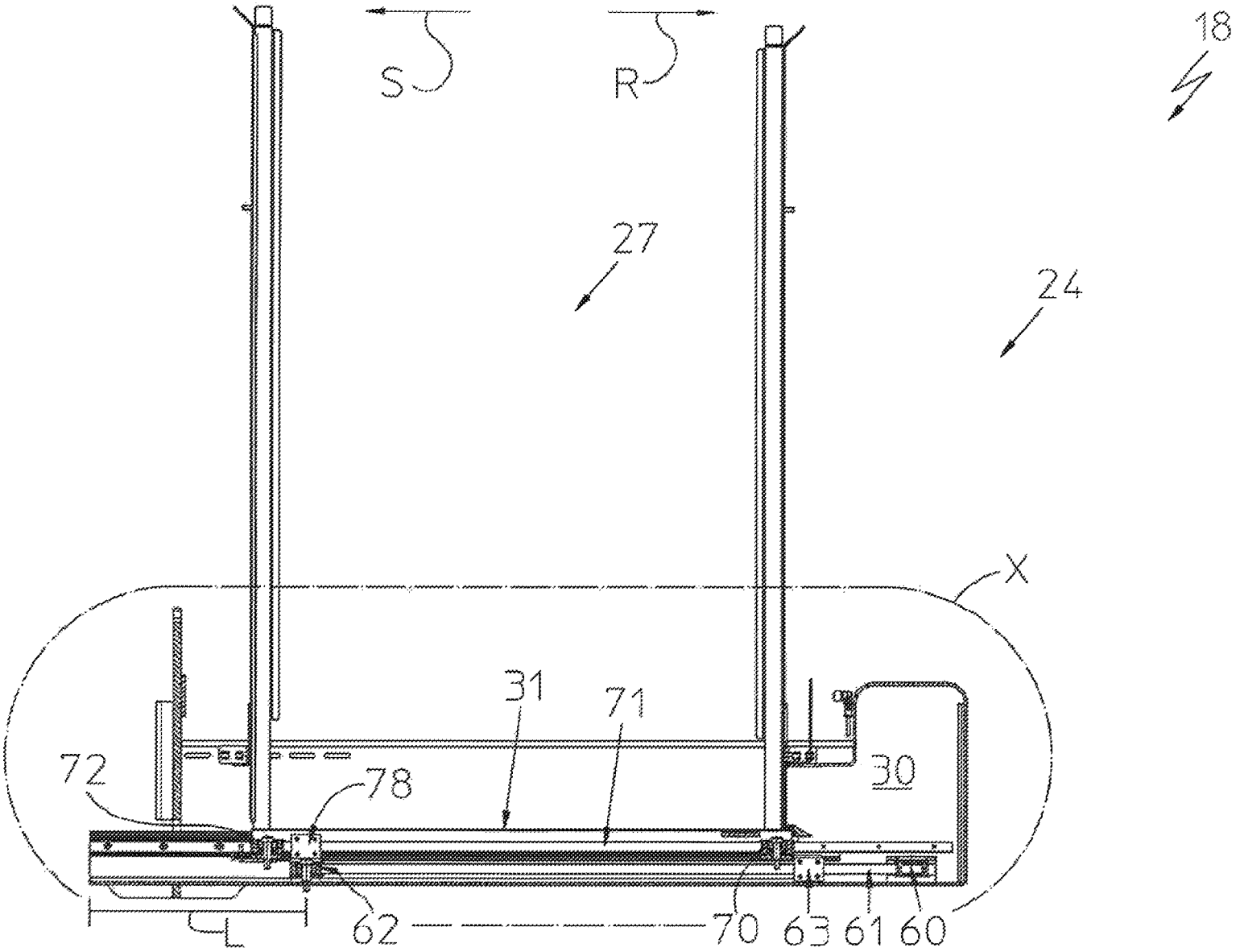
FIG. 6 illustrates the edge-protector magazine of FIG. 2 in a cross-sectional view according to the section line A-A in FIG. 4.
Figure 7:
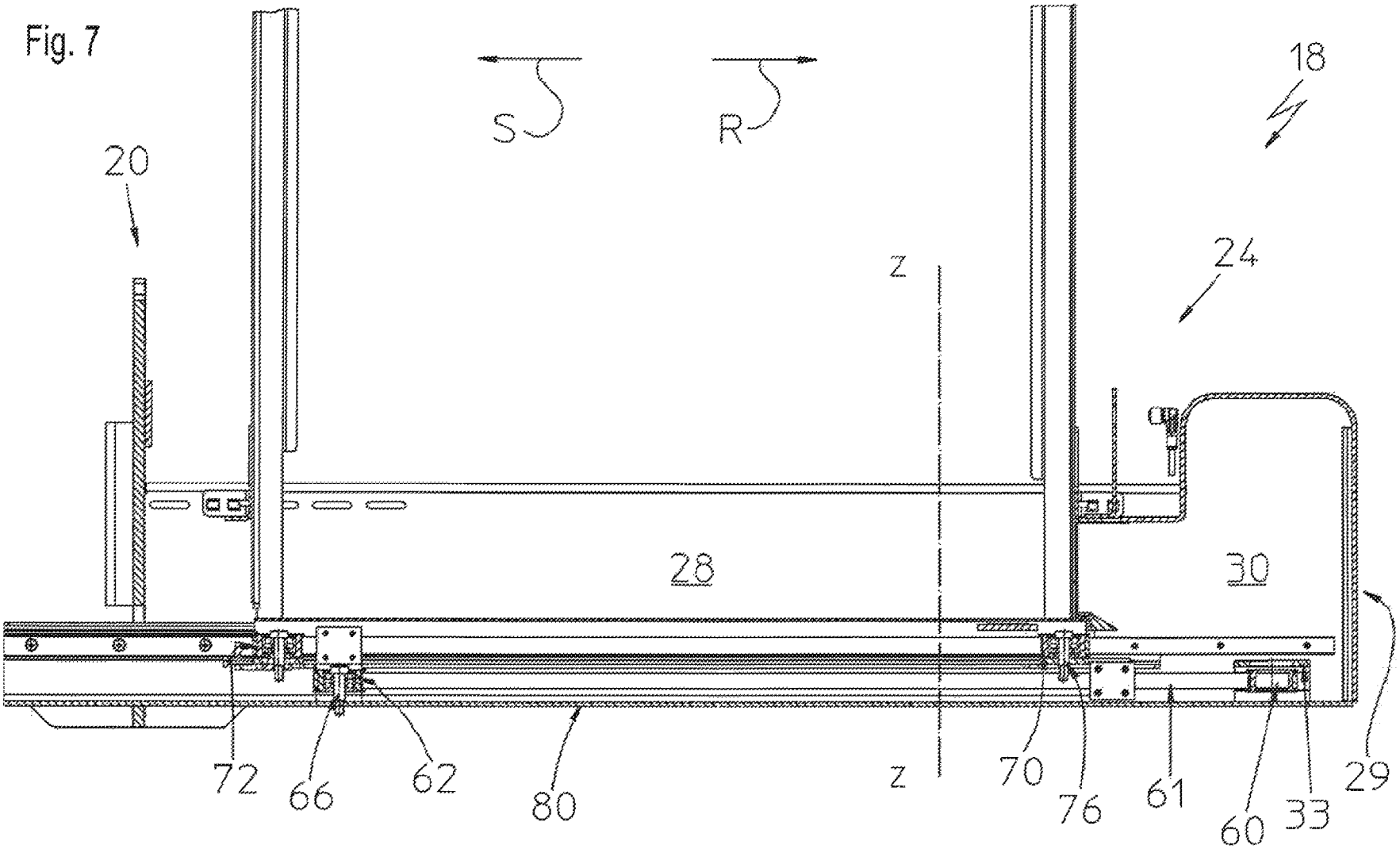
FIG. 7 illustrates an enlarged fragmentary view of the edge-protector magazine of FIG. 2 according to the circle X in FIG. 6.
Figure 10:
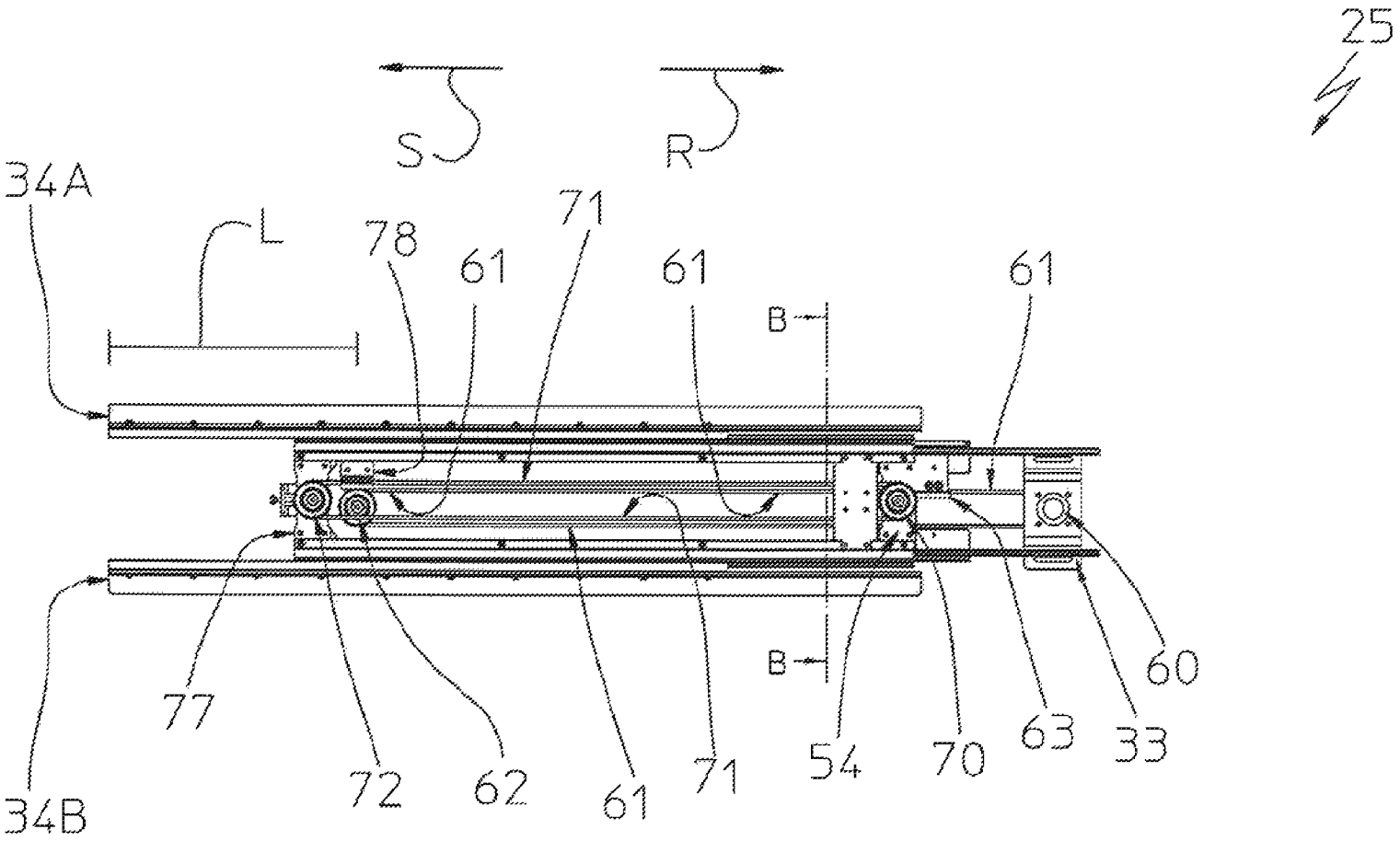
FIG. 10 illustrates a view from above onto the telescopic rail assembly for moving the conveying member between its home and discharge positions.

FIG. 6 shows a longitudinal section through the edge-protector magazine 18 along the section line A-A in FIG. 4. An enlarged illustration of the fragment circle X is shown in FIG. 7. A plan view of the telescopic rail assembly 25 disposed in the magazine frame 24 is shown in FIG. 10. The further construction of the telescopic rail assembly 25 will now be described with respect to FIGS. 7 and 10. For improved clarity it is to be pointed out once again here that the illustration of FIG. 13 is a sectional illustration according to the section line B-B in FIG. 10, and the position of the section line B-B can be found in the plane Z-Z in FIG. 7.

As can be seen from FIGS. 7 and 10, the first drive belt 61 is guided so as to revolve about the first belt pulley 60 and the second belt pulley 62. Driving the first belt pulley 60 thus leads to a continuous revolving movement of the first drive belt 61. The second belt pulley 62, like the first belt pulley 60, is established so as to be locationally fixed on the magazine frame 24. As is shown in FIG. 7, the second belt pulley 62 by way of a pulley axle 66 is fastened to a base plate 80 of the magazine frame 24.

However, the first belt clamp 63, which is coupled to the assembly plate 45, prevents the first drive belt 61 moving in a completely revolving manner. Consequently, driving the first belt pulley 60 leads to a deployment movement of the inner guide rails 42A and 42B of the outer pair of telescopic rails 40 (not indicated in FIGS. 7 and 10) when the first belt pulley 60 is moved in a counter-clockwise manner in terms of the illustration of FIG. 10. By virtue of the likewise existing coupling of the assembly plate 45 to the outer guide rails 51A and 51B, the inner pair of telescopic rails 50 is also moved in the deployment direction.

The second drive belt 71 is guided so as to revolve about the third belt pulley 70 and the fourth belt pulley 72.

The fourth belt pulley 72 is fastened on a belt pulley support 77. The belt pulley support 77 is held by the inner guide rails 42A and 42B of the outer pair of telescopic rails 40, and is fastened to the inner guide rails 42A and 42B in a locationally fixed manner.

The third belt pulley 70 as well as the fourth belt pulley 72 in terms of movement are thus coupled to the inner guide rails 42A and 42B and in a deployment movement of the outer pair of telescopic rails 40 are conjointly moved in the deployment direction S.

Figure 11:
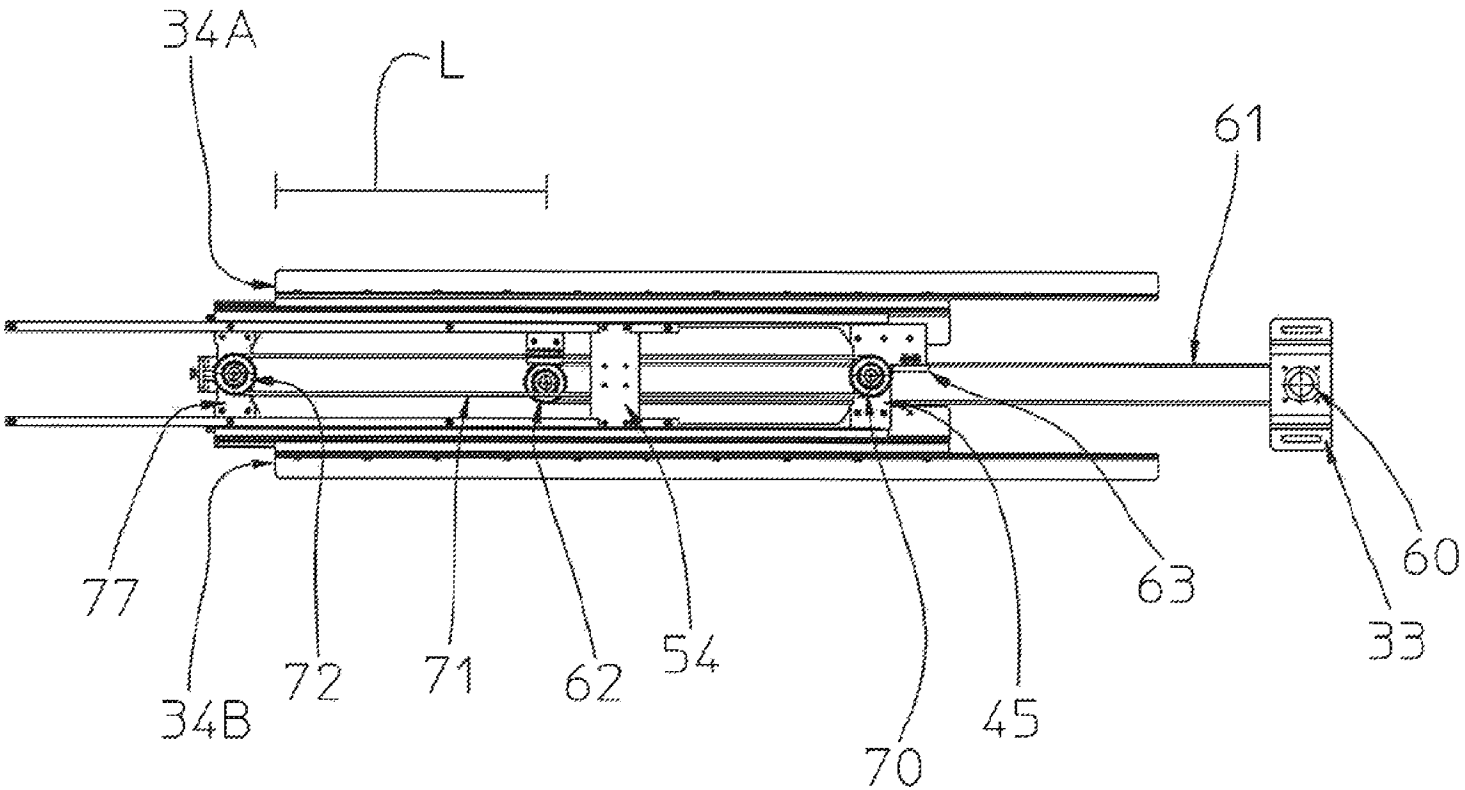
FIG. 11 is a view similar to FIG. 10 but with the telescopic rails partially extended.
Figure 12:
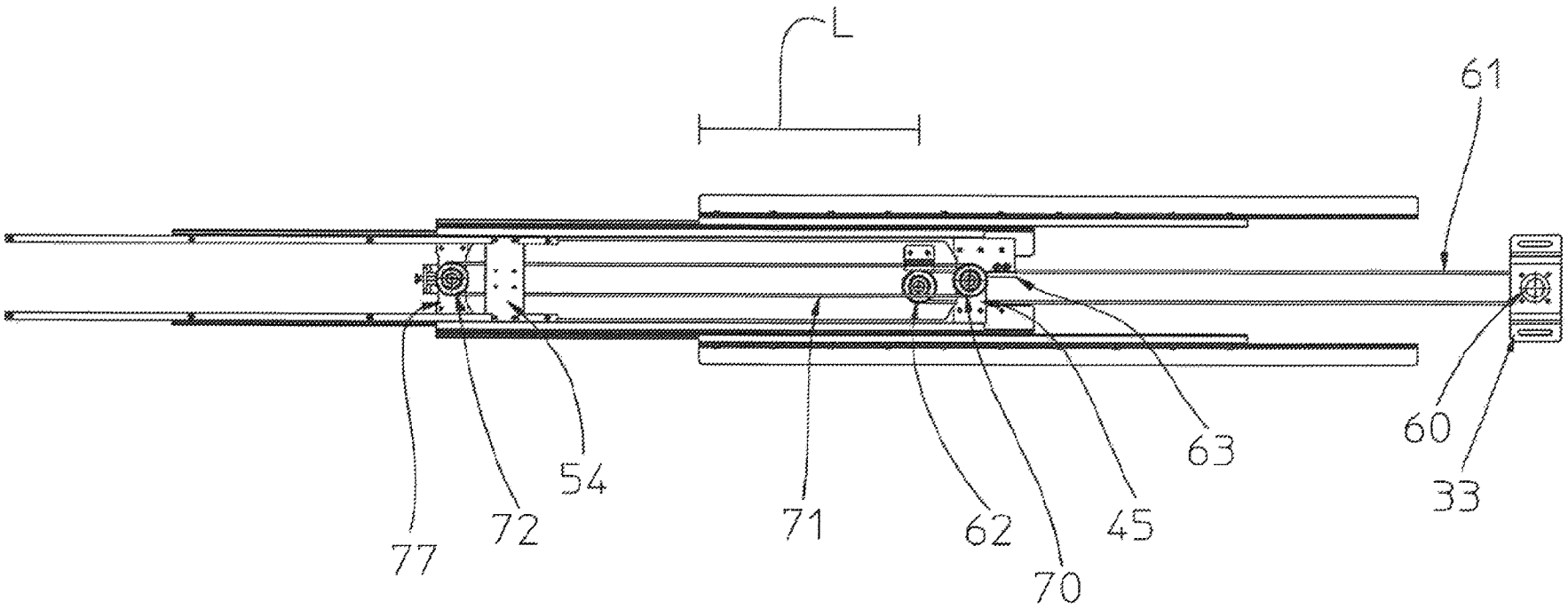
FIG. 12 is a view similar to FIG. 10 but with the telescopic rails completely extended.

A third belt clamp 78 is decisive in terms of the deployment movement of the inner guide rails 52A and 52B of the inner pair of telescopic rails 50. The third belt clamp 78 is constructed identically to the first belt clamp 63 and the second belt clamp 73, respectively, and is fixedly connected to the second drive belt 71. The third belt clamp 78 is fastened so as to be locationally fixed on a magazine frame 24. The third belt clamp 78 in a discharging direction S or in a retracting direction R counter to the discharging direction S therefore does not perform conjointly. In FIGS. 10 to 12, illustrating the deployment movement this is demonstrated in that the distance L between the end of the bracket 34*a* close to the press plate and the third belt clamp 78 has a constant length L.

The telescopic rail assembly 25 illustrated in the figures and having been explained in detail in terms of construction and function serves for deploying the conveying member 31 from its home position and to move the conveying member 31 to a discharge position (in the deployment direction S), and to subsequently move the conveying member 31 from the discharge position back to its home position (the retracting movement R). This movement of the telescopic rail assembly 25 will now be explained with respect to FIGS. 10 to 12. FIG. 10 shows the telescopic rail assembly 25 with the conveying member 31 in its home position, while FIG. 11 shows the commencing movement in the discharging direction S for reaching the discharge position. FIG. 12 shows the telescopic rail assembly 25 with the conveying member 31 in its discharge position.

To initiate a movement of the telescopic rail assembly 25 in the deployment direction S, the drive (not illustrated) moves the first belt pulley 60 in the counter-clockwise direction. The first drive belt 61 which is guided so as to revolve in the first belt pulley 60 and the second belt pulley 62 likewise moves in the counter-clockwise direction. The drive belt 61 imposes on the first belt clamp 63 a movement in the deployment direction S. The inner guide rails 42A and 42B of the outer pair of telescopic rails 40 that are coupled to the first belt clamp 63, as well as the outer guide rails 51A and 51B of the inner second pair of telescopic rails 50, are likewise conveyed in the deployment direction S.

The inner guide rails 42A and 42B on the assembly plate 45 remote from the press plate support the third belt pulley 70, and on the belt pulley support 77 close to the press plate support the fourth belt pulley 72. The third belt pulley 70 and the fourth belt pulley 72 are moved in the discharging direction S conjointly with the inner guide rails 42A and 42B of the first pair of telescopic rails 40. This leads to a relocation of the second drive belt 71 which is guided so as to revolve about the third belt pulley 70 and the fourth belt pulley 72, the relocation being in relation to the initial position of the second drive belt 71 illustrated in FIG. 10. Since the second drive belt 71 by way of the third belt clamp 78 is on one side disposed so as to be locationally fixed on the magazine frame 24, the relative relocation of the second drive belt 71 leads to a rolling movement about the third belt pulley 70 fourth belt pulley 72, the rolling movement taking place in the clockwise direction here. The assembly bridging bracket 54 and the inner guide rails 52A and 52B of the second inner pair of telescopic rails that are coupled to the assembly 54 herein are moved in the deployment direction S. The second drive belt 71 is consequently set in motion not directly but only indirectly by the drive.

The coupling in terms of movement between the inner pair of telescopic rails 50 and the outer pair of telescopic rails 40 can be used in an analogous manner for coupling a third pair of telescopic rails (not illustrated here) to the second pair of telescopic rails 50. An even further spacing between the home position and the discharge position could be breached in this way, without the length of the telescopic rail assembly 25 measured in the direction of movement S/R increasing.

The movement of the conveying member 31 from its home position to its discharge position by way of the telescopic rail assembly 25 will now be described with respect to FIGS. 6 to 9. FIG. 6 herein shows the conveying member 31 in its home position in the region of the storage space 27 of the edge-protector magazine 18. In its home position, the conveying member 31 is located below a stack of edge protectors 19 which is not illustrated here, wherein the bottommost edge protector of the storage stack bears on the conveying member 31.

Figure 9:
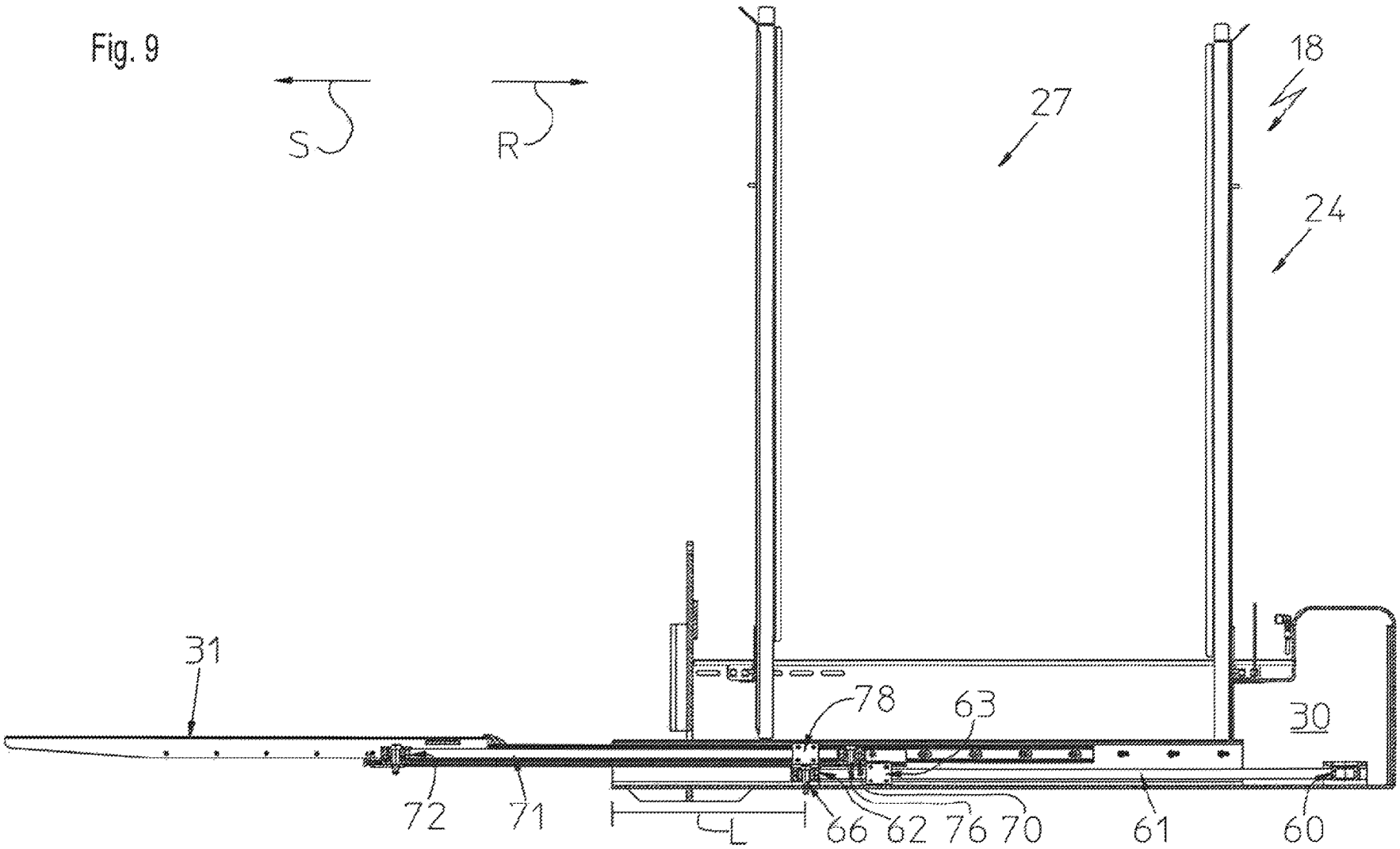
FIG. 9 is a view similar to FIG. 6 but with the conveying unit completely deployed.

The conveying member 31 in FIG. 9 assumes the discharge position thereof, thus has covered the maximum distance of movement thereof in the discharging direction, or the deployment direction S, respectively.

Figure 8:
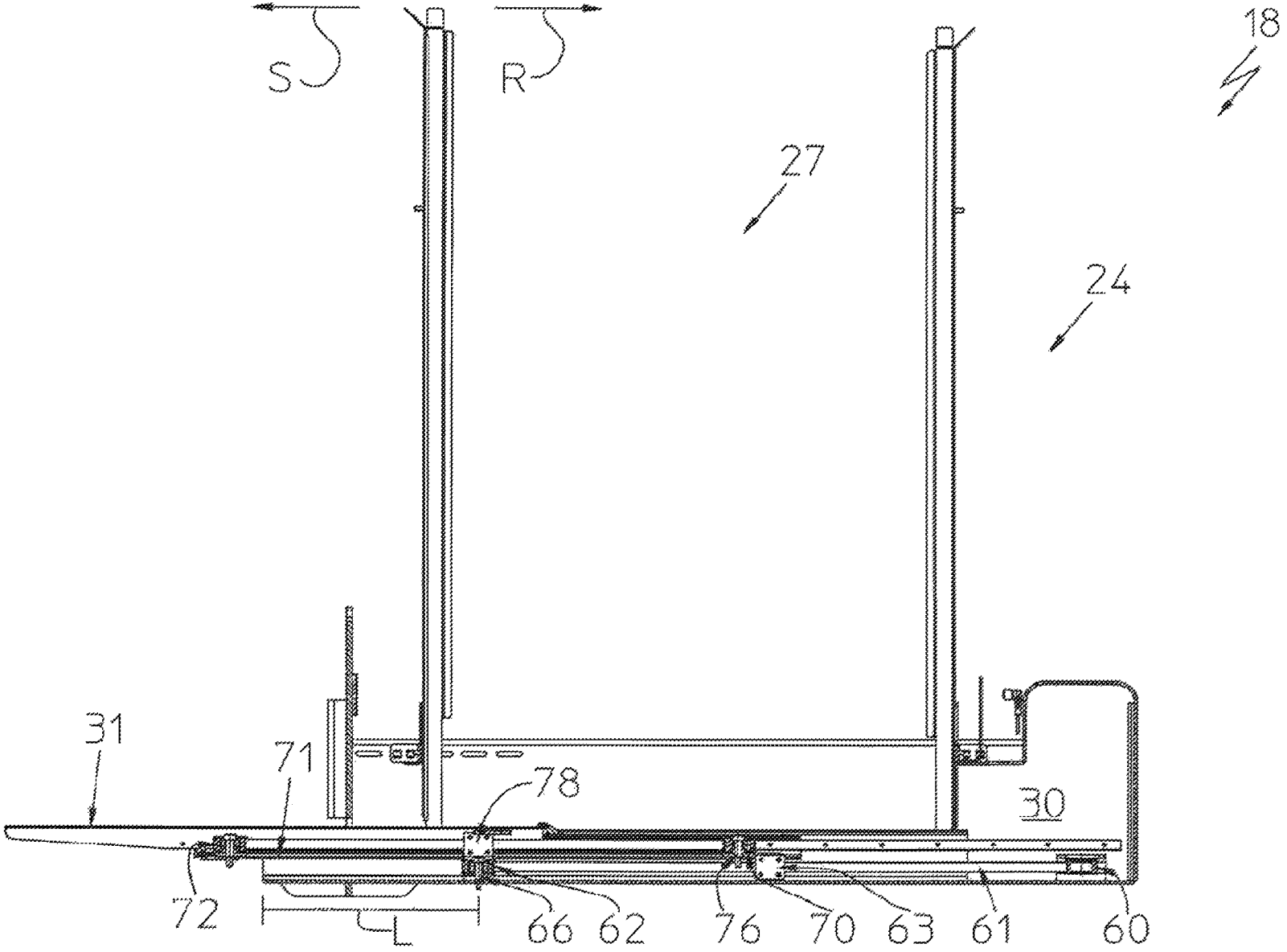
FIG. 8 is a view similar to FIG. 6 but with the conveying unit partially deployed.

FIG. 8 shows an intermediate position of the conveying member 31 on the way thereof in the discharging direction S between its home position (FIG. 6) and its discharge position (FIG. 9).

For the deployment movement in the discharging direction S of the conveying member 31 to be initiated, the drive, in particular the motor (not illustrated), is put in operation and the first belt pulley 60, in a manner analogous to that described above in relation to FIGS. 10 to 12, is moved in the counter-clockwise direction. On account thereof, the pairs of telescopic rails 40 and 50 are imparted the deployment movement thereof in the deployment direction S. The conveying member 31 which by way of the assembly bridging bracket 54 in terms of movement is coupled to the inner pair of telescopic rails 50 follows this movement. The conveying member 31 from its home position below the storage space 27 of the edge-protector magazine 18 is moved in the discharging direction S in the direction of the press plate and in the direction of the positioning installation disposed there (FIG. 8) until the conveying member 31 has reached its discharge position (FIG. 9). The conveying member 31 herein transports an edge protector (not illustrated in FIGS. 6, 8, and 9) from the storage space 27 of the edge-protector magazine 18 and moves the edge protector to the discharge position (FIG. 9) so as to transfer the edge protector to the positioning unit (not illustrated). After the edge protector 19 has been acquired by the positioning unit, the drive is again actuated, wherein the rotating direction of the latter is reversed. Consequently, the drive now drives the first belt pulley 60 in the clockwise direction. On account thereof, the deployed telescopic rails 42A, 42B, 50A, 50B, 51A, and 51B are moved in the retracting direction R as the conveying member 31 returns back to its home position. The conveying member 31 plunges below the bottommost edge protector 19 within the storage space 27 (edge protector not illustrated), so as to in a new discharging movement discharge the bottommost edge protector 19 in the discharge direction S.

Figure 14:
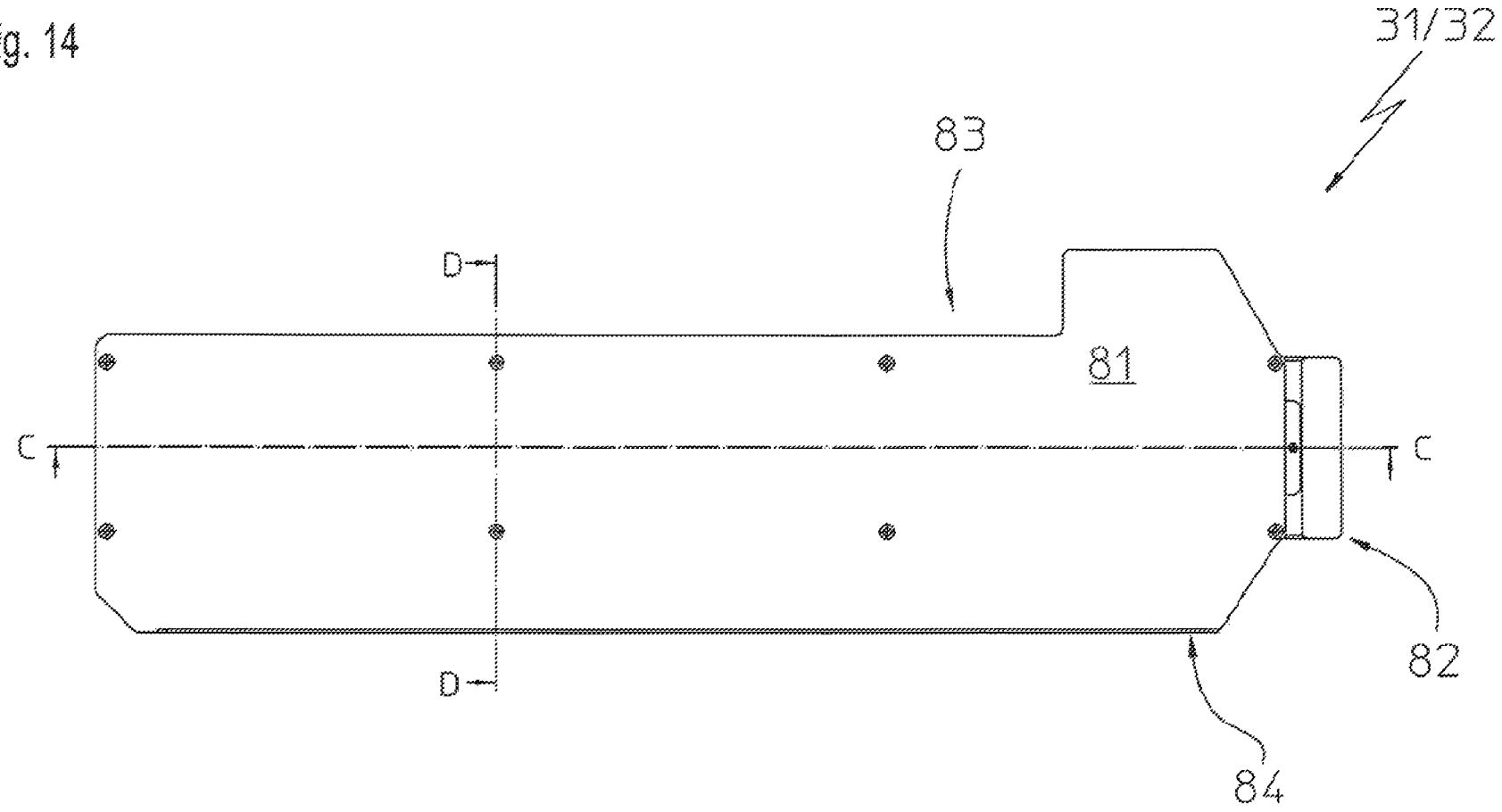
FIG. 14 illustrates a plan view of the conveying member.
Figure 15:
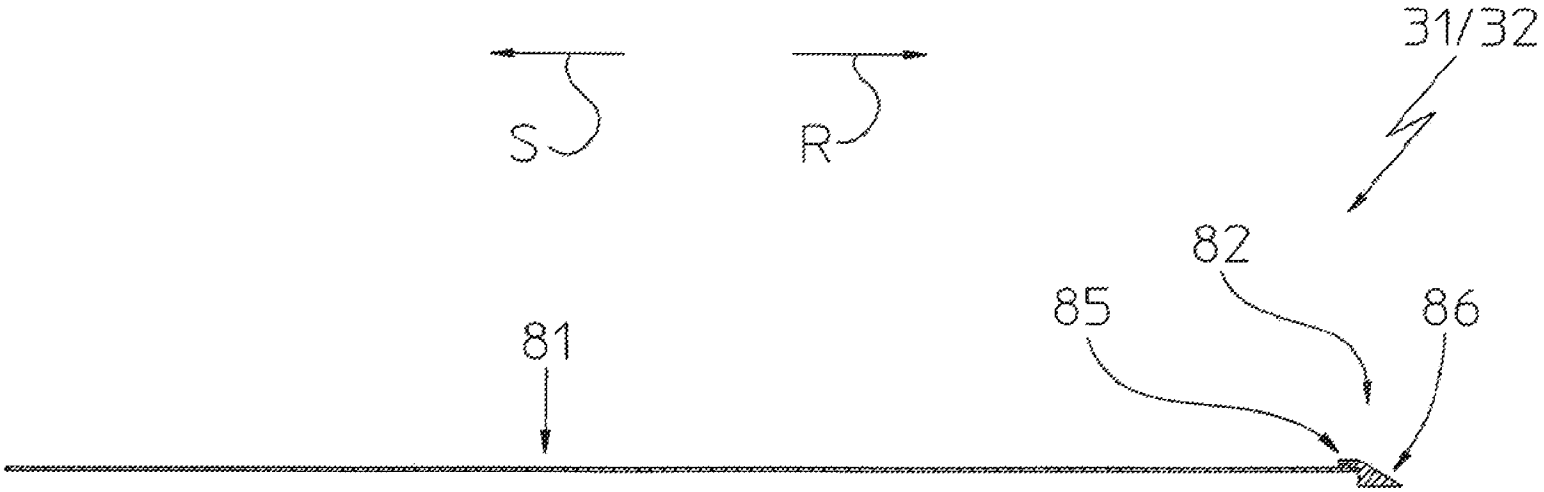
FIG. 15 illustrates the conveying member in a cross-sectional view according to the section line C-C in FIG. 14.
Figure 16:
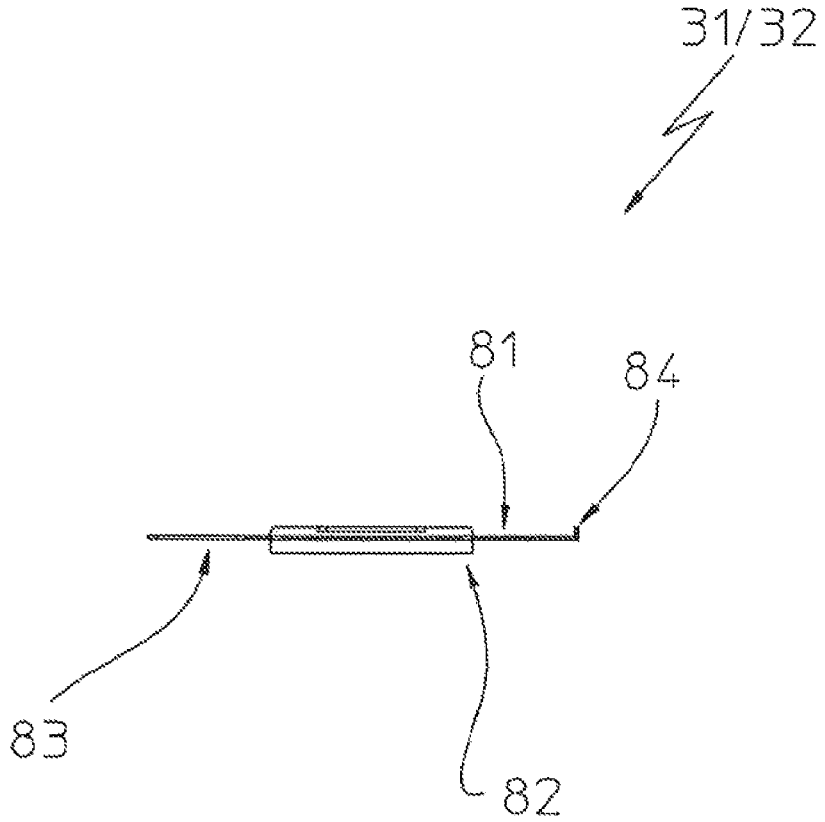
FIG. 16 illustrates the conveying member in a cross-sectional view according to the section line D-D in FIG. 14.

The conveying member 31 is illustrated in various views in FIGS. 14 to 16. FIG. 14 shows a plan view of the conveying member 31 configured as the receptacle plate 32. The conveying member 31 possesses a receptacle face 81 which faces the storage space 27, or the edge protector 19 disposed therein, respectively, and possesses a separating web 82 which is disposed at the end of the receptacle face that faces away from the press plate. A clean cut 83 of the receptacle plate 32 permits a gripping member of the positioning installation to hold an edge protector 19 which bears on the receptacle face 81. To this extent, the clean cut 83 can also be referred to as a tool engagement. The receptacle face 81 opposite the clean cut 83 possesses a detent web 84. The edge protector 19 by way of a longitudinal edge bears on the detent web 84.

When the conveying member 31 is located in its discharge position, the positioning unit from a side that faces away from the detent web 84 approaches the conveying member 31. The gripping tool of the positioning unit acquires a region of the edge protector which by virtue of the clean cut 83 is exposed. The detent web 84 prevents that the edge protector 19 can be pushed off the receptacle face 81 by the gripping tool of the positioning unit.

In this context, reference is to be made to FIG. 16, which shows a sectional illustration according to the section line D-D in FIG. 14 and in which the detent web 84 that delimits the receptacle face 81 can be seen.

The separating web 82 in terms of construction and function can be best explained with respect to FIG. 15. The FIG. 15 is a longitudinal section of the conveying member 31 according to the section line C-C in FIG. 14. The separating web 32 first possesses a conveying edge 85 which points toward the receptacle face 81, or to the edge protectors which bear thereon and are not illustrated in FIG. 15, respectively. The height of the conveying edge 85 corresponds approximately to the thickness of an edge protector 19 and engages on the periphery of the edge protector 19 so as to entrain the latter in the discharging direction S when the conveying member 31 is moved to its discharge position.

The rear side of the separating web 82 that faces away from the press plate and points in the retracting direction R slopes in a wedge-shaped manner such that the oblique face 86 created on account thereof points upwards, thus in the direction of the edge protectors that are disposed in the manner of a stack in the storage space 27. The wedge-shaped design of the detent web 84 in a retracting movement in the retracting direction R of the conveying member ensures that the conveying member 31 is moved below the bottommost edge protector 19 that is disposed in the storage space 27 of the edge-protector magazine 18 such that precisely the bottommost edge protector 19 comes to bear on the receptacle face 81 when the conveying member 31 reaches its home position.

As is demonstrated by the description of the exemplary embodiment of the invention, the telescopic rails 40/50 enable a compact conveying unit to be achieved which moves the conveying member 31 from a home position to a discharge position and back. The longer the distance between the home position and the discharge position to be overcome, the more telescopic rails 40/50 are to be used. The exemplary embodiment herein demonstrates how the telescopic rails 40/50 can be disposed so as to be coupled to one another below the storage space 27 within the magazine frame 24, without an installation space that exceeds the base area of the edge-protector magazine 18 having to be used.

Apart from the minimizing of the installation space, it is a further substantial advantage that the use of telescopic rails 40/50 significantly minimizes the masses to be moved, and that the edge-protector magazine 18 consequently can be of a lighter construction.

Finally, the use of telescopic rails enables a belt drive to be used. The belt drive when interacting with the minor masses enables the discharging and retracting movement to be accelerated and thus more strapping actions to be performed in a defined temporal period.

Moreover, certain embodiments of the present disclosure use a motor, in particular a servomotor, as the drive. The servomotor has the substantial advantage that the sensors thereof detect the rotary position of the motor shaft, thus making precise controlling of the drive possible. Moreover, specific operating states and states of wear and tear of the telescopic rail assembly 25 can be detected by way of the electronic closed-loop control system of the servomotor. Load peaks, detectable by way of voltage peaks or current peaks, indicate briefly increased resistances to movement when deploying or retracting the telescopic rails 40/50, for example. The increased resistances to movement may indicate wear and tear of bearings, drive belts 61/71, or belt pulleys 60/62/70/72. In conjunction with suitable communication modules, such measured values can be transmitted to a position within the organization which is responsible for maintenance. The responsible position in the context of regular machine maintenance or preventive machine maintenance can then replace defective parts in a timely manner ahead of machine breakdowns such that machine downtime and thus losses are avoided.

LIST OF REFERENCE SIGNS

10 Strapping machine
11 Packing table
12 Vertical support
13 Press plate
14 Protective housing
15 Strap supply
16 Roller
17 Load
18 Edge-protector magazine
19 Edge protector
20 Assembly plate
21 Bores
22 Passage opening
23 Receptacle supports
24 Magazine frame
25 Telescopic rail assembly
26 Guide lip
27 Storage space
28 Frame walls
29 Rear wall
30 Drive space
31 Conveying member
32 Receptacle plate
33 Drive mount
34A Bracket
34B Bracket
40 Outer pair of telescopic rails
40A First telescopic rail
40B First telescopic rail
41A Outer guide rail
41B Outer guide rail
42A Inner guide rail
42B Inner guide rail
43 Intermediate space
44 Screw connection
45 Assembly plate
46A Assembly angle bracket
46B Assembly angle bracket
50 Inner pair of telescopic rails
50A Second telescopic rail
50B Second telescopic rail
51A Outer guide rail
51B Outer guide rail
52A Inner guide rail
52B Inner guide rail
53 Intermediate space
54 Assembly bridging bracket
60 First belt pulley
61 First drive belt
62 Second belt pulley
63 First belt clamp
64 First clamping jaw
65 Second clamping jaw
66 Pulley axle
70 Third belt pulley
71 Second drive belt

72 Fourth belt pulley
73 Second clamping jaw
74 Third clamping jaw
75 Fourth clamping jaw
76 Pulley axle
77 Belt pulley support
78 Third clamping jaw
80 Base plate
81 Receptacle face
82 Separating web
83 Clean cut
84 Detent web
85 Conveying edge
86 Oblique face
S Discharging direction
R Retracting direction
L Distance

The invention claimed is:

1. A strapping machine for positioning an edge protector on an edge of a load and for strapping the load, the strapping machine comprising:

a packing table;

two supports on opposing sides of the packing table;

a press plate supported by and vertically movable relative to the supports, wherein the packing table, the supports, and the press plate define a strap chute; and an edge-protector magazine supported by the press plate, the edge-protector magazine comprising:

a magazine frame defining a storage space sized to receive a stack of edge protectors;

a telescopic rail assembly supported by the magazine frame and comprising a first outer telescopic rail and a first inner telescopic rail, wherein the first outer telescopic rail comprises a first outer guide rail and a first inner guide rail received in and movable relative to the first outer guide rail in a discharging direction and a retracting direction, and wherein the first inner telescopic rail comprises a first outer guide rail and a first inner guide rail received in and movable relative to the first outer guide rail in the discharging and retracting directions;

a conveying unit mounted to the telescopic rail assembly and movable between a home position and a discharge position, wherein at least part of the conveying unit is below the storage space when in the home position and removed from the storage space when in the discharge position; and a drive operably connected to the telescopic rail assembly and configured to extend the telescopic rail assembly to move the conveying unit in the discharging direction from its home position to its discharge position and to retract the telescopic rail assembly to move the conveying unit in the retracting direction from its discharge position to its home position.

2. The strapping machine of claim 1, wherein the drive comprises a motor.

3. The strapping machine of claim 1, wherein the first outer guide rail of the first outer telescopic rail is fixed relative to the magazine frame, and wherein the first inner guide rail of the first outer telescopic rail is operably connected to the first inner telescopic rail such that the first inner telescopic rail moves with the first inner guide rail of the first outer telescopic rail in the discharging and retracting directions.

4. The strapping machine of claim 3, wherein the first inner guide rail of the first inner telescopic rail is operably connected to the conveying unit such that the conveying unit moves with the first inner guide rail of the first inner telescopic rail in the discharging and retracting directions.

5. The strapping machine of claim 4, wherein the drive is operably connected to the first inner guide rail of the first outer telescopic rail to cause the first inner guide rail to move relative to the magazine frame in the discharging and retracting directions, and wherein movement of the first inner guide rail of the first outer telescopic rail in the discharging and retracting directions causes the first inner guide rail of the first inner telescopic rail to move relative to the first outer telescopic rail in the discharging and retracting directions.

6. The strapping machine of claim 5, wherein the telescopic rail assembly further comprises first and second pulleys, a first belt connecting the first and second pulleys, and a first clamp fixedly attached to the first belt and operably connected to the first inner guide rail of the first outer telescopic rail and the first outer guide rail of the first inner telescopic rail, wherein the drive is operably connected to the first pulley to drive the first pulley in a first rotational direction to cause the first belt to move around the first and second pulleys in the first rotational direction such that the first clamp moves in the discharging direction, thereby causing the first inner guide rail of the first outer telescopic rail and the first outer guide rail of the first inner telescopic rail to move in the discharging direction, and wherein the drive is operably connected to the first pulley to drive the first pulley in a second rotational direction to cause the first belt to move around the first and second pulleys in the second rotational direction such that the first clamp moves in the retracting direction, thereby causing the first inner guide rail of the first outer telescopic rail and the first outer guide rail of the first inner telescopic rail to move in the retracting direction.

7. The strapping machine of claim 6, wherein the telescopic rail assembly further comprises third and fourth pulleys, a second belt connecting the first and second pulleys, a second clamp fixedly attached to the second belt and fixed relative to the magazine frame, and a third clamp fixedly attached to the second belt and operably connected to the first inner guide rail of the first inner telescopic rail, wherein movement of the first inner guide rail of the first outer telescopic rail and the first outer guide rail of the first inner telescopic rail in the discharging direction causes the second belt to move around the third and fourth pulleys in a third rotational direction such that the third clamp moves in the discharging direction, thereby causing the first inner guide rail of the first inner telescopic rail and the conveying unit to move in the discharging direction, wherein movement of the first inner guide rail of the first outer telescopic rail and the first outer guide rail of the first inner telescopic rail in the retracting direction causes the second belt to move around the third and fourth pulleys in a fourth rotational direction such that the third clamp moves in the retracting direction, thereby causing the first inner guide rail of the first inner telescopic rail and the conveying unit to move in the retracting direction.

8. The strapping machine of claim 7, wherein the first and fourth rotational directions are the same rotational direction, and wherein the second and third rotational directions are the same rotational direction.

9. The strapping machine of claim 7, wherein the telescopic rail assembly further comprises an assembly plate to which the first inner guide rail of the first outer telescopic rail, the first outer guide rail of the first inner telescopic rail, and the first clamp are fixedly mounted.

10. The strapping machine of claim 9, wherein the telescopic rail assembly further comprises an assembly bridging bracket to which the conveying unit, the third clamp, and the first inner guide rail of the first inner telescopic rail are fixedly mounted.

11. The strapping machine of claim 10, wherein the telescopic rail assembly further comprises:

a second outer telescopic rail comprising a first outer guide rail and a first inner guide rail received in and movable relative to the first outer guide rail in the discharging and retracting directions; and a second inner telescopic rail comprising a first outer guide rail and a first inner guide rail received in and movable relative to the first outer guide rail in the discharging and retracting directions, wherein the first outer guide rail of the second outer telescopic rail is fixed relative to the magazine frame, wherein the first inner guide rail of the second outer telescopic rail and the first outer guide rail of the second inner telescopic rail are fixedly mounted to the assembly plate;

wherein the first inner guide rail of the second inner telescopic rail is fixedly mounted to the assembly-bridging bracket.

12. The strapping machine of claim 1, further comprising a positioning unit supported by the press plate and configured to receive an edge protector from the conveying unit of the edge-protector magazine when the conveying unit is in its discharge position and to position the edge protector on the edge of the load.

13. The strapping machine of claim 1, further comprising a controller operably connected to the drive to control operation of the drive.

* * * * *